US005429190A

United States Patent [19]

Kilgore et al.

[11] Patent Number: 5,429,190

[45] Date of Patent: Jul. 4, 1995

[54] SLICK LINE CASING AND TUBING JOINT LOCATOR APPARATUS AND ASSOCIATED METHODS

[75] Inventors: Marion D. Kilgore; John J. Goiffon, both of Dallas; Jack G. Clemens, Plano; David R. Larimore, Carrollton, all of Tex.

[73] Assignee: Halliburton Company, Houston, Tex.

[21] Appl. No.: 292,633

[22] Filed: Aug. 18, 1994

Related U.S. Application Data

[63] Continuation-in-part of Ser. No. 146,678, Nov. 1, 1993, Pat. No. 5,361,838.

[51] Int. Cl.[6] ..... E21B 47/09; G01V 3/11; G01V 3/28

[52] U.S. Cl. ..... 166/255; 73/151; 166/64; 166/65.1; 166/66.4; 166/113; 324/221

[58] Field of Search ..... 166/255, 250, 254, 241.5, 166/113, 65.1, 66.4, 64; 324/220, 221, 326; 73/151

[56] References Cited

U.S. PATENT DOCUMENTS

| | | | |
|---|---|---|---|
| 2,476,137 | 7/1949 | Doll | 166/255 X |
| 2,602,833 | 7/1952 | Swift | 175/183 |
| 2,746,550 | 5/1956 | Mitchell, Jr. | 166/255 |
| 2,812,587 | 11/1957 | Roussin | 166/241.5 X |
| 2,967,994 | 1/1961 | Peterson | 324/221 |
| 3,019,841 | 2/1962 | Ternow | 166/55.1 |
| 3,088,068 | 4/1963 | Hall, Jr. et al. | 324/221 |
| 3,291,208 | 12/1966 | Kenneday | 166/255 |
| 3,396,786 | 8/1968 | Schuster et al. | 166/255 |
| 3,434,046 | 3/1969 | Wilson et al. | 324/221 X |
| 3,902,361 | 9/1975 | Watson | 73/151 |
| 4,023,092 | 5/1977 | Rogers | 324/221 |
| 4,067,386 | 1/1978 | Weise | 166/64 |
| 4,711,303 | 12/1987 | Koeling et al. | 166/64 X |
| 4,794,336 | 12/1988 | Marlow et al. | 324/221 |

*Primary Examiner*—Stephen J. Novosad

*Attorney, Agent, or Firm*—Tracy W. Druce; J. Richard Konnecker

[57] ABSTRACT

A detector structure is used to sense and log the joints in a downhole jointed tubular structure, such as a well bore casing or production tubing, in a subterranean well. The detector is moved through the jointed tubular structure on an elongated positioning member, representatively a slick line, through a series of joints to be logged. As the detector passes through each joint it electromagnetically senses the joint and responsively generates an electric output signal. The output signal is used to momentarily cause a drag structure portion of the detector, in cooperation with the interior side surface of the tubular structure, to momentarily create a detectable tension change in the elongated positioning member. Alternatively, a pyrotechnic or compressed gas device may be used to create the detectable changes in response to the generation of the electrical output signals. These tension changes, which may be either tension increases or tension decreases, serve as mechanical output signals transmitted upwardly through the positioning member, and may be plotted on a strip chart recorder at the surface to record the joint locations and correlate them to the lowered depth odometer readings of the detection system. Using this joint detection apparatus, correlative joint logging procedures may be carried out for tool setting purposes without the necessity of utilizing an electrical conductor line.

22 Claims, 6 Drawing Sheets

SLICK LINE CASING AND TUBING JOINT LOCATOR APPARATUS AND ASSOCIATED METHODS

CROSS-REFERENCE TO RELATED APPLICATION

This application is a continuation-in-part of U.S. application Ser. No. 08/146,678 filed on Nov. 1, 1993, now U.S. Pat. No. 5,361,838, and entitled "SLICK LINE CASING AND TUBING JOINT LOCATOR APPARATUS AND ASSOCIATED METHODS".

BACKGROUND OF THE INVENTION

The present invention generally relates to well logging apparatus and, in a preferred embodiment thereof, more particularly relates to apparatus and methods for detecting joints at adjacent sections of a jointed tubular structure, such as a bore hole casing or production tubing, in a subterranean well.

It is often necessary in a completed subterranean well to precisely locate one or more of the joints that join the various longitudinal sections of a jointed tubular structure, such as a bore hole casing or production tubing. This need arises, for example, when it is necessary to precisely locate a tool such as a perforating gun, or another downhole structure such as a packer, within the jointed tubular structure relative to a well structure previously installed therein, such as a set of casing perforations. The tool to be set at a predetermined location within the tubular structure is typically lowered into the tubular structure on an elongated positioning member such as a slick line or a length of coil tubing, and the depth of the previously installed well structure may be readily found on the previously recorded joint and tally log for the well.

Given this readily available information it would seem at first glance to be a rather straightforward task to simply lower the tool into the tubular structure until the lowered depth odometer reading for the elongated positioning member was equal to the indicated joint log and tally depth for the previously installed well structure plus (or minus as the case may be) the desired offset distance between the tool to be set and the previously installed well structure. However, due to the considerable stretch of the elongated positioning member at substantial tool lowering depths, this approach is often characterized by an unacceptably low degree of tool positioning accuracy. Specifically, the odometer reading is not identical to the actual lowered depth of the tool.

For years the drilling and well services have employed various correlative joint logging techniques to indirectly overcome these tool positioning inaccuracies. One such technique entails the lowering of an electronic joint sensor into the jointed tubular structure on an electrically conductive wireline to detect a spaced series of joints in the general vicinity of the desired tool positioning location, and determine the lengths between the adjacent pairs of joints using the joint-to-joint odometer readings.

Using the fact that the joint-to-joint lengths in a jointed tubular structure such as a bore hole casing or production tubing tend to be detectably nonuniform, the series of determined joint-to-joint lengths are "matched" to an identical series of joint-to-joint lengths on the previously-recorded joint and tally log to identify precisely which series of joints have been detected.

Using this correlated logging information, a precise correspondence between the odometer readings and the actual lowered depth of the joint sensor may be arrived at. In turn, this information may be used to determine an odometer reading precisely corresponding to the desired tool setting depth and the tool may then be lowered to this odometer reading with its precise positioning assured.

During this joint logging procedure, as the joint sensor is longitudinally moved, on the electrically conductive wireline, through the general tubular structure vicinity of interest it electromagnetically detects mass changes in the tubular structure indicative of the joints therein. Upon detecting a joint the sensor responsively generates an electrical signal pulse which is appropriately amplified and transmitted to the surface through the wireline. These electrical signal pulses are transmitted to and imprinted on an appropriate single pin strip chart recorder side-by-side with the corresponding lowered depth odometer readings. In addition to the post-completion correlative logging operations described above, wireline joint logging may also be used in initial logging procedures to establish, for example, the joint and tally log itself.

While wireline logging operations of this type are quite accurate, they also tend to be undesirably expensive, particularly in subsequent correlation logging operations for tool setting purposes, due to wireline footage charges and the crew and surface equipment typically required to carry out the wireline logging operations.

Heretofore the use of slick line (such as monofilament steel cable) in downhole tool setting procedures requiring correlative logging, although potentially less expensive than its wireline counterpart, has not been considered practical because of the inability to accurately correlate the location of the tool connected to the slick line with the location of previously installed well structures. Stated in another manner, while various sophisticated and relatively expensive equipment may be used in conjunction with a slick line to compensate for line stretch inaccuracies and precisely determine the depth of the tool in the tubular structure, conventional slick line tool setting systems have not had the capability of also performing the correlative logging functions necessary to precisely locate the tool relative to previously installed equipment in the jointed tubular structure.

In addition to electronic joint detectors of the type described above, various mechanical joint detectors have also been proposed. These types of detectors are typically provided with radially biased finger structures that resiliently enter the interior recesses of "cavity" type joints and provide detectable weight variations on the weight indicator at the surface when the finger structures snap into the joint recesses as the joint sensor is longitudinally moved through the tubular structure. The weight indicator variations constitute mechanical joint detection signals which may be used in the location of tools within a jointed tubular structure.

While mechanical joint detection apparatus of this general type does not require the transmission of electrical signals to the surface, and thus avoid the attendant expense of an electrically conductive wireline, it also has a decidedly undesirable limitation in that it can only detect joints of the cavity type. It cannot be used to detect "flush" type joints since joints of this type do not have interior recesses for the mechanical joint detector finger structures to snap into.

From the foregoing it can be readily seen that a need exists for improved tubular structure joint detection apparatus and associated methods that eliminate, or at least substantially minimize, the above-mentioned problems, limitations and disadvantages typically associated with conventional joint detection apparatus and methods. It is accordingly an object of the present invention to provide such improved apparatus and methods.

SUMMARY OF THE INVENTION

In carrying out principles of the present invention, in accordance with a preferred embodiment thereof, electromechanical detection apparatus is provided for detecting joints, or other changed mass sections of a jointed tubular structure (either increased or decreased mass sections therein), such as a bore hole casing or production tubing, in a subterranean well. Using the apparatus, joints of either the cavity or flush type may be detected without the necessity of using an electrical conductor line to lower the apparatus into the jointed tubular structure.

From a broad standpoint the apparatus comprises a mass change detection structure, movable through a well bore jointed tubular structure (for example, a well bore casing or production tubing) on an end of an elongated positioning member, such as a slick line, a braided metal cable, or a length of coil tubing, and operable to detect the locations of a spaced series of joints or other changed mass sections of the tubular structure. The detection structure includes first means for sensing each changed mass tubular structure portion through which the detection structure passes as it is moved either upwardly or downwardly through the tubular structure on the elongated positioning member, and responsively generating an electrical output signal.

Second means, responsive to the generation of each electrical output signal, are operative to cause a portion of the joint detection structure to cooperate with the tubular structure in a manner momentarily creating, during vertical movement of the detection structure, detectable tension changes in the elongated positioning member which are indicative of the downhole positions of the sensed increases or decreases in tubular structure mass. The tension changes may be either increases or decreases in the tension in the elongated positioning member.

Representatively, the second means may be either a mechanical or electromagnetic drag mechanism that cooperates with the interior surface of the tubular structure, in response to the generation of each electrical output signal, to momentarily create a detectable tension change in the elongated positioning member. This momentary tension change may be either positive or negative depending on the vertical direction the detection structure is being moved during the generation of each electrical output signal.

Alternatively, the second means may be a pyrotechnic or compressed gas device carried by the detection structure and operative, in response to the generation of each electrical output signal, to momentarily accelerate the vertically moving detection structure (either upwardly or downwardly as desired) to create the mechanical tension change in the elongated positioning member indicative of the sensing of a changed mass portion of the tubular structure.

The conventional need to transmit electrical signals through the elongated positioning member is thus advantageously eliminated. Instead, each joint, upset or other changed mass section of the tubular structure is electrically sensed by the first means, representatively using electromagnetic sensing means, and the detection structure utilizes the output of the electromagnetic sensing means to responsively operate the second means to generate mechanical joint detection signals in the elongated positioning member which may be correlated to lowered length odometer readings at the surface to determine the depth of the joints being logged. Since the joints are electromagnetically sensed, the operation of the mass change detection structure is independent of the internal configuration of the joints or other changed mass sections of the tubular structure.

DETAILED DESCRIPTION

Figure 1:
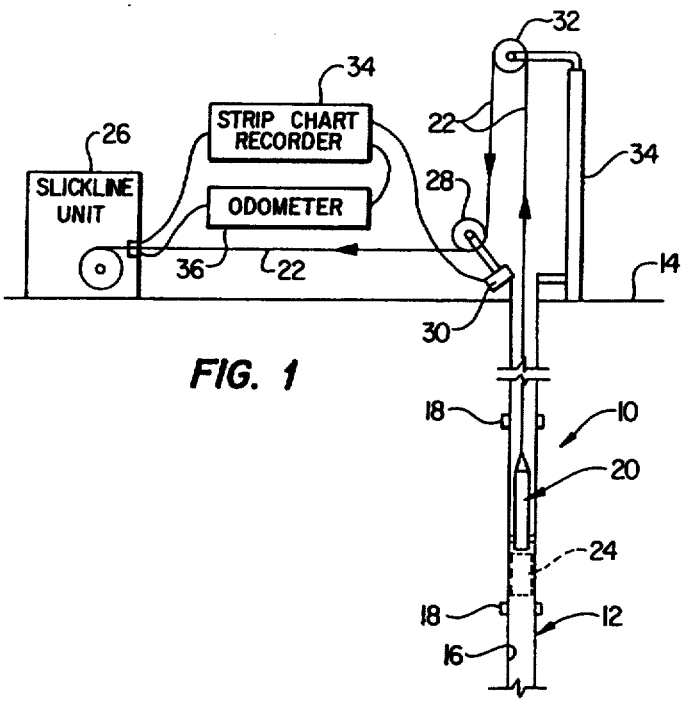
FIGS. 1 and 2 are schematic illustrations of a well bore tubular structure joint logging and tool location method performed using a specially designed electromechanical joint logging structure embodying principles of the present invention.
Figure 2:
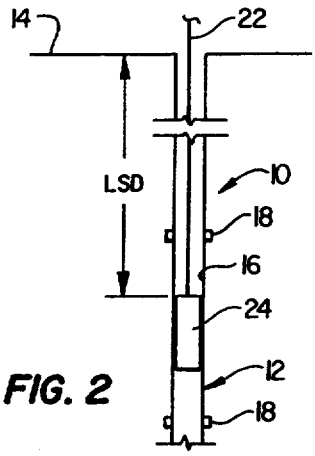

Schematically illustrated in FIGS. 1 and 2 is a representative subterranean well completion 10 in which a tubular casing structure 12 extends downwardly from the earth's surface 14 and interiorly lines a bore hole 16. As is customary, the casing 12 is formed from individual lengths of tubular casing material joined end-to-end by casing collar joints 18.

The present invention provides a specially designed collar logging structure 20 (see FIG. 1) which is lowered into the casing 12 on a length of slick line 22 and is used to detect a predetermined number of the collars 18, in a manner subsequently described, for use in accurately positioning a tool, such as the perforating gun 24 shown in FIG. 2, in the casing 12 relative to a well structure (such as casing perforations) previously installed therein.

The slick line 22 is stored in a conventional surface slick line unit 26. From the unit 26 the slick line 22 passes under a lower pulley 28 connected in a force transmitting relationship to a load cell 30, over an upper pulley 32 mounted on a stanchion structure 34, and is secured at its lower end to the upper end of the collar detection structure 20. A conventional single pen strip chart recorder 34 and an odometer 36 are operatively interconnected between the slick line unit 26 and the load cell 30 as schematically indicated in FIG. 1.

In performing the collar logging operation, the collar detection structure 20 is lowered on the slick line 22 into the casing 12 to the general depth therein (as indicated on the odometer 22) at which the tool 24 is to be subsequently located. The slick line 22 is then reeled in at a relatively slow controlled rate to move the collar detection structure 20 upwardly past a predetermined number of casing collar joints 18 (for example, ten collar joints) in the region of interest.

In a manner subsequently described, the collar or joint detection structure 20 electromagnetically detects each of the collars through which it upwardly passes. In response to its sensing of each of the collars 18 the structure 20 is automatically brought into a momentary motion inhibiting engagement with the interior surface of the casing 12, thereby mechanically creating detectable increases or "spikes" 38*a* in the line pull line 38 being marked on the moving recorder strip 40 (see FIG. 3). The longitudinal movement velocity of the strip 40 is appropriately correlated to the upward velocity of the collar detection structure 20 within the casing 12, and the tension spikes 38*a* are aligned with corresponding odometer readings on the odometer scale portion of the strip 40.

Figure 3:
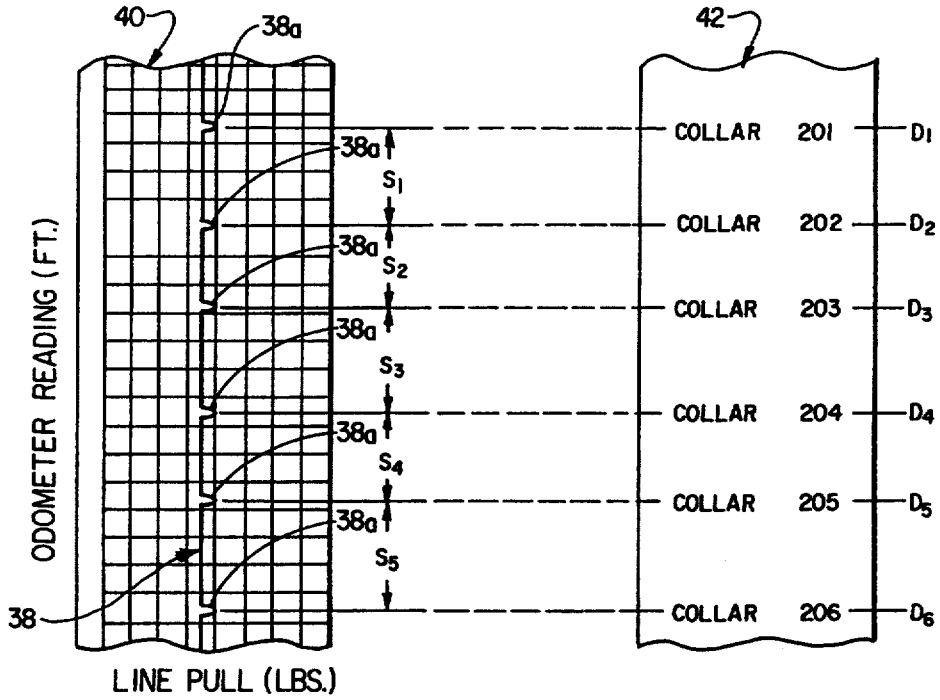
FIG. 3 is a schematic illustration of a strip chart/joint and tally log correlation technique used in conjunction with the joint logging method.

A representative six tension increase spikes 38*a* are depicted on the chart recorder strip 40 shown in FIG. 3 and correspond to six detected collar joints 18, the five slick line distances $S_1$–$S_5$ being indicative of the slick line distances between the vertically successive pairs of collar joints as may be determined from the odometer scale on the strip 40. In the correlative collar logging procedure being discussed herein, a matching set of collar-to-collar distances $S_1$–$S_5$ is found on the well's previously recorded collar log and tally 42 to determine, for example, that the collars located by the collar detection structure 20 are collars 201 through 206 respectively located at depths $D_1$–$D_6$ in the well casing.

This determination of the exact collars logged by the collar detection structure 20 permits the operator of the slick line unit 26, by comparing the odometer readings on the strip 40 at each tension spike 38*a* to the actual casing depths $D_1$–$D_6$, to arrive at a conversion factor that accurately relates the slick line odometer reading to the actual depth to which the collar detection structure has been lowered into the casing 12. After this conversion factor, which compensates for slick line stretch, has been determined the collar detection structure 20 may be pulled out of the casing 12, and replaced with the tool 24 (see FIG. 2) which may then be lowered on the slick line 22 into the casing 12 to a lowered slick line depth LSD (as indicated on the odometer 36) equal to the desired tool depth as corrected by the previously determined conversion factor.

Alternatively, as schematically illustrated in dotted lines in FIG. 1, the tool 24 may be lowered into the casing 12 on the collar detection structure 20 and used without removing the structure 20 from the casing. This method of utilizing the detection structure 20 is seen to be preferable since both the logging operation and the subsequent use of the tool 24 may be carried out in a single trip down the casing 12. Additionally, since the weight on the slick line 22 is the same in both the logging operation and the subsequent use of the tool, the positioning of the tool 24 will be even more precise.

According to a key feature of the present invention, the collar detection structure 20 frictionally creates detectable slick line tension increases corresponding to the detected collar locations, thereby eliminating the previous necessity of transmitting an electrical detection signal upwardly through an electrically conductive wire extending from the collar sensor to the surface. Thus, the need for an electric line with its attendant crew and expense, is eliminated. Moreover, as will be seen, the creation of the mechanical collar detection signals by the structure 20 is not dependent on the geometry of the sensed collars. Specifically, the collar detection structure 20 may be used to sense either recessed or flush-type collar joints.

Figure 4:
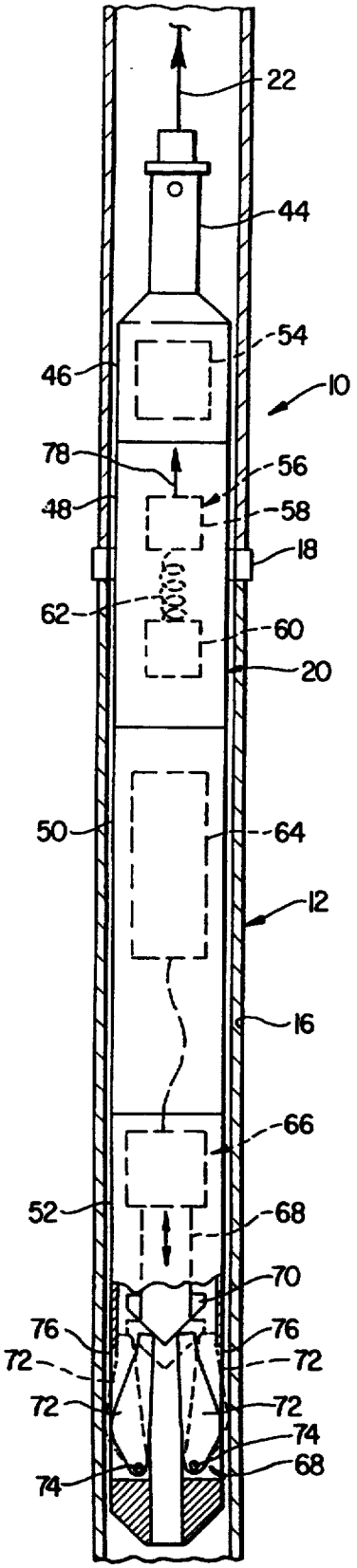
FIG. 4 is an enlarged scale, partially elevational schematic cross-sectional view through the joint logging structure.

Turning now to FIG. 4, the collar detection structure 20 has an elongated cylindrical configuration with, from top to bottom along its length, a connection section 44 to which the lower end of the slick line 22 may be secured; a control section 46; a sensor section 48; a battery pack section 50; and a solenoid and drag structure section 52. A control and timing circuit 54 is disposed in section 46, and a conventional electromagnetic mass sensing structure 56, comprising a vertically spaced pair of magnets 58,60 between which a coil 62 is connected, is disposed within the section 48. Coil 62 is operatively connected to the control section 46. Control section 46 is operatively connected to a storage battery 64 which is disposed in section 50 and is, in turn, operatively connected to a solenoid structure 66 disposed within the section 52 above a drag structure 68 therein.

The solenoid structure 68 has a vertically reciprocable plunger portion 68 with a tapered lower end 70. Lower plunger end 70 is positioned above the upper ends of a diametrically opposed pair of vertically elongated drag arm members 72 which are pivotally secured at their lower ends, as at 74, within the bottom section 52. The drag arm members 72 are disposed at vertically extending slots 76 in section 52 for pivotal movement between their solid line release positions, in which the drag members are positioned within the section 52, and their dotted line casing engagement positions in which the drag members 72 extend outwardly through the slots 76.

After the collar detection structure 20 has been lowered on the slick line 22 into the casing 12 past the vertical series of collars 18 to be logged by the detection structure, the slick line 22 is pulled upwardly to move the detection structure 20 upwardly through the collars. As the sensor section 48 upwardly traverses each collar joint 18 the sensing structure 56 electromagnetically senses the increased casing mass created by the collar and responsively outputs an electrical signal 78 to the control section 46. In response to the creation of this electrical output signal 78 the battery 64 momentarily energizes the solenoid 66 and causes its plunger portion 68 to be downwardly driven to its indicated dotted line position to thereby cause the plunger bottom end portion 70 to forcibly engage the upper ends of the drag arm members 72.

This momentary forcible engagement of the upper drag member ends by the bottom plunger end portion 72 pivots the drag arm members 72 from their solid line positions to their dotted line positions in which outer side portions of the drag arm members forcibly engage the interior side surface of the casing 12, thereby momentarily increasing the tension in the slick line 22 and creating one of the line pull spikes 38*a* on the recorder strip 40 (see FIG. 3). The solenoid plunger 68 is then upwardly retracted to permit the drag arm members 72 to pivot inwardly to their solid line release positions, thereby causing the recorder strip tension line 38 to return to its baseline level.

As the sensor section 48 upwardly traverses each vertically successive collar joint 18 to be logged, this process of momentarily increasing the slick line tension is repeated by again energizing and quickly deenergizing the solenoid 64 to forcibly pivot the drag arm members 72 outwardly through the detection structure body slots 76 and then permit them to inwardly pivot to their retracted release positions.

The schematically depicted control and timing circuit 54 is of a conventional construction and operates in the same general manner as the timing circuitry typically incorporated in electromagnetic collar sensors used in conventional wireline collar logging systems. Prior to the lowering of the collar detection structure 20 into the casing 12 a time-down portion of the circuit 54 is set to disable operation of the solenoid for a predetermined time period. This prevents the drag arm members 72 from being driven into forcible frictional engagement with the casing 12 each time the collar detection structure 20 passes downwardly through a casing collar on its way down to its starting position within the casing. When the detection structure 20 reaches such starting position (i.e., just below the vertical series of collars to be logged) it is permitted to remain motionless within the casing for the balance of this initial preset time-down period.

A conventional pre-set still time detector and a motion detector incorporated in the control section 46 cooperate to prevent the drag structure from working until the detection structure 20 has remained motionless for this time-down period. The circuitry in the control section 46 operates in a manner such that if motion of the detection structure 20 is detected within this initial time-down period the still-time clock is automatically reset to zero lapsed time. Only when the detection structure 20 remains motionless for the time-down period will the control section circuitry arm the drag structure. Once armed, the drag structure is operative only for a preset armed period during which the motion detection portion of the circuitry is bypassed. After the armed period has expired the drag structure is automatically rendered inoperative, and to reset the arming circuitry the detection structure must be pulled to the surface and reset.

The detection structure 20 shown in FIG. 4 has been representatively described as being operated by lowering it into the casing 20, with its drag arm members 72 in their solid line retracted positions, past the collar joints to be sensed, and then raising the detection structure 20 upwardly through the joints to be sensed to thereby cause the drag arm members 72 to be forced outwardly to their dotted line extended positions, in response to each generation of the electrical signal 78, to create the slick line tension increase spikes 38*a* shown in FIG. 3.

Figure 10:
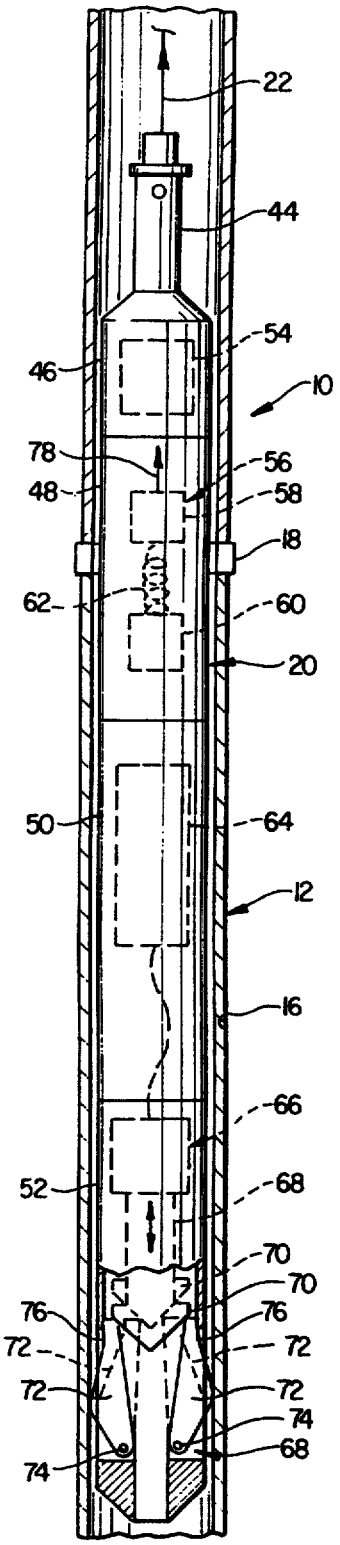
FIGS. 10–12 are views similar to that in FIG. 4 and illustrate alternate modes of operation for the joint logging structure shown in FIG. 4.

However, the detection structure 20 could be utilized in several alternate manners if desired. For example, as illustrated in FIG. 10, as the detection structure 20 is raised through the collar joints 18 to be detected the drag arm members 72 could be maintained in their solid line extended positions in which they slide against the inner side surface of the casing 12, thereby increasing the tension in the slick line 22 beyond the tension created therein by the weight of the detection structure 20. Then, when the sensing structure 56 passes upwardly through each of the collar joints 18 and responsively generates its electrical output signal 78, the solenoid plunger 68 can be lifted from its solid line position to its dotted line position to permit the drag arm members 72 to retract from their solid line positions to their dotted line positions.

This momentary retraction of the drag arm members 72 momentarily decreases the slick line tension until the sensing structure 56 exits each collar 18 and the cessation of the electrical signal 78 causes the solenoid plunger 68 to be driven downwardly back to its solid line position to forcibly extend the drag arm members 72 to their solid line positions and again increase the slick line tension. The momentary slick line tension decreases, indicative of the electromagnetic sensing of the collars 18, would be indicated on the FIG. 3 moving recorder strip 40 as tension decrease spikes (not shown) projecting leftwardly from the main portion of the line pull line 38 in place of the line tension increase spikes 38*a*.

In each of the two operating modes of the detection structure 20 shown in FIGS. 4 and 10 the detection structure 20 is lowered through the collars 18 to be sensed and then pulled upwardly through the collars to perform the actual collar detection operation. However, if desired, the detection structure 20 could also be used to detect the collars 18 as the detection structure 20 passes downwardly through the collars 18.

Figure 11:
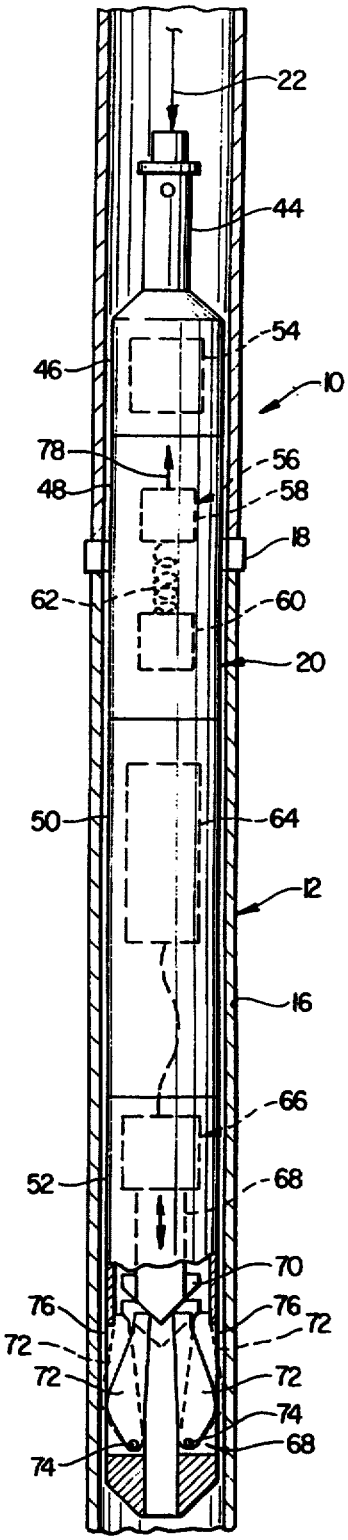

For example, as illustrated in FIG. 11, as the detection structure 20 is lowered through the collars 18 to be detected the drag arm members 72 are initially maintained in their solid line retracted positions. In response to each momentary generation of the electrical output signal 78, though, the drag arm members 72 are momentarily extended to their dotted line positions in which they forcibly engage the inner side surface of the casing 12. This momentarily decreases the slick line tension, with the resulting tension decrease spikes on the moving recorder strip 40 indicating the depths of the sensed collars 18.

Figure 12:
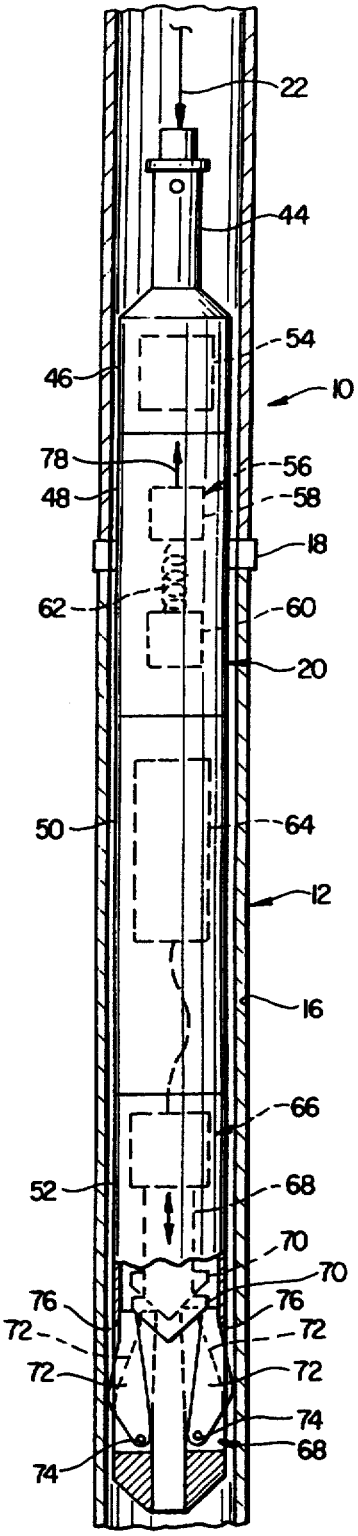

Alternatively, as illustrated in FIG. 12, as the detection structure 20 is lowered through the collars 18 to be detected the drag arm members 72 may be maintained in their solid line extended positions in which they forcibly engage and slide along the inner side surface of the casing 12, thereby decreasing the slick line tension force below that created therein by the weight of the detection structure 20. Upon each momentary generation of the electrical output signal 78, the drag arm members 72 are momentarily retracted to their dotted line positions, thereby momentarily increasing the slick line tension. These momentary slick line tension increases are reflected as recording strip tension increase spikes similar to the spikes 38a shown in FIG. 3.

Figure 5:
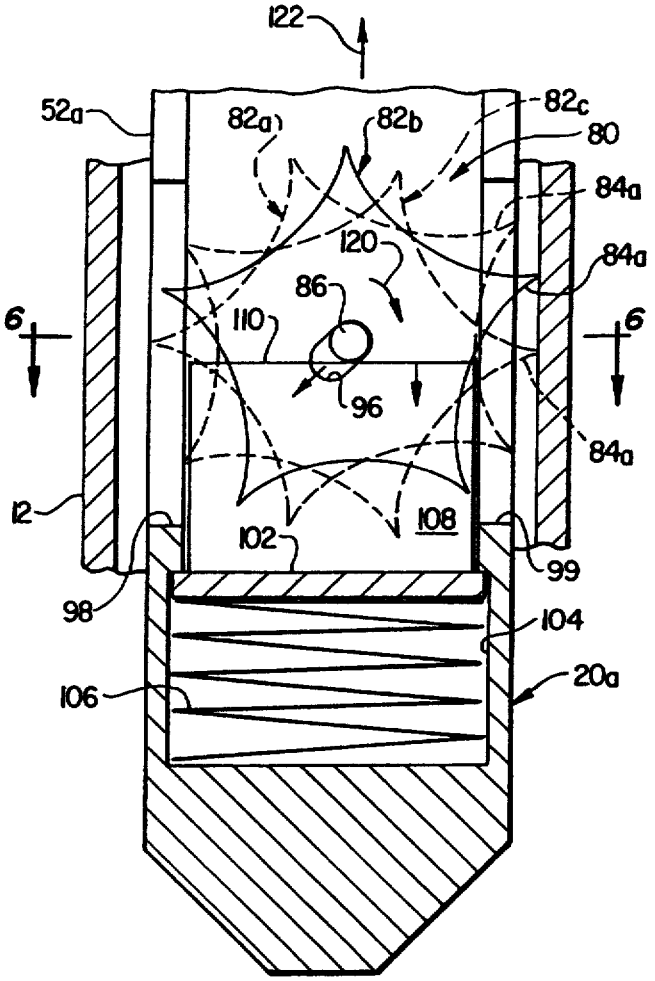
FIG. 5 is an enlarged scale partly schematic cross-sectional view through a lower end portion of a first alternate embodiment of the joint logging structure.

A lower end portion of an alternate embodiment 20a of the previously described collar detection structure 20 is cross-sectionally illustrated in FIG. 5 in a simplified, somewhat schematic form. The collar detection structure 20a is identical to the structure 20 with the exception that a modified drag structure 80 is incorporated in its solenoid and drag structure section 52a. The modified drag structure 80 includes a drag wheel 82 which is shown in three rotational positions in FIG. 5 - (1) an initial dotted line position 82a; (2) a second, solid line position 82b in which the drag wheel has been rotated a short distance away from position 82a in a clockwise direction; and (3) a third, dotted line position 82c in which the drag wheel has been rotated a short distance away from position 82b in a clockwise direction.

Referring now to FIGS. 5-9, the drag wheel 82 has formed thereon a circumferentially spaced series of radially outwardly projecting points 84 including the reference point 84a which will be subsequently used herein to describe the operation of the modified drag structure 80. A cylindrical support shaft 86 is fixedly secured to and transversely extends centrally through the drag wheel 80, and longitudinally extends outwardly beyond detent and ratchet boss structures 88 and 90 fixedly secured on opposite sides of the drag wheel 82. For purposes later described, the boss 88 has a series of flat side surfaces 92 disposed around its lateral periphery, and the boss 90 has a circumferentially spaced series of generally tangentially facing driving surfaces 94 formed around its lateral periphery.

Figure 6:
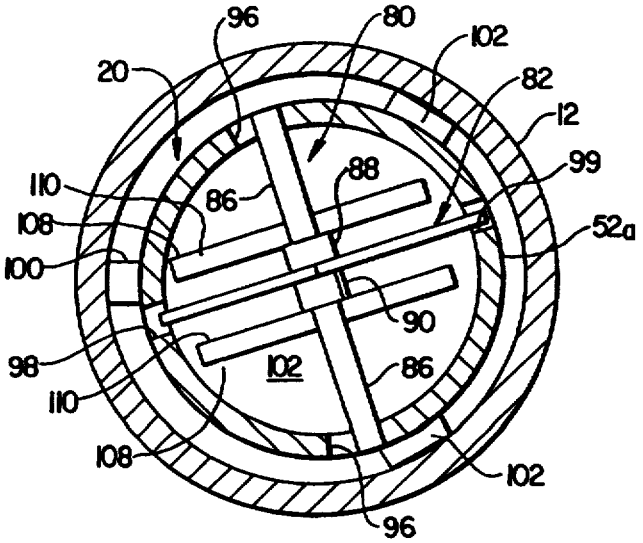
FIG. 6 is a simplified cross-sectional view through the first alternate joint logging structure embodiment taken along line 6—6 of FIG. 5.

As best illustrated in FIGS. 5 and 6, the outer ends of the shaft 86 are received in elongated, vertically inclined slots 96 formed in diametrically opposite side wall portions of the hollow body of the solenoid and drag structure section 52a. Additionally, opposite side edge portions of the drag wheel 82 are aligned with, and may be rotated outwardly through, a diametrically opposite pair of vertically elongated slots 98,99 formed in the side wall portion of the section 52a. The section 52a is resiliently maintained in a laterally spaced relationship with the interior side surface of the casing 12 by means of a lug member 100 and a pair of leaf spring members 102 externally secured to and circumferentially spaced around the section 52a and bearing against the inner side surface of the casing 12. The radial thickness of the lug member 100 is sized in a manner such that, for purposes later described herein, the vertical slot 99 is somewhat closer to the interior surface of the casing 12 than the vertical slot 98 is.

Figure 7:
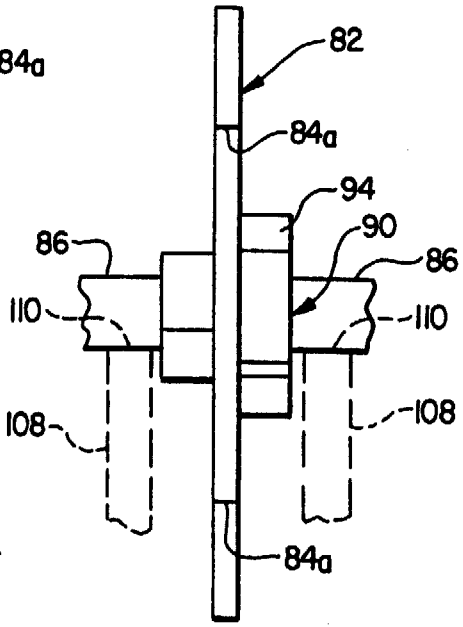
FIG. 7 is an enlarged scale side edge elevational view of a drag member used in the first alternate embodiment of the joint logging structure.

A pressure plate member 102 is slidably retained and vertically movable within a complementarily configured chamber 104 formed in the body of section 52a. Pressure plate member 102 is resiliently biased toward its upper limit position indicated in FIG. 5 by a schematically depicted compression spring 106 disposed in the chamber 104 and bearing at its opposite ends against the bottom end surface of the chamber and the underside of the pressure plate 102. Extending upwardly from the top side of the pressure plate 102 are a spaced pair of biasing plates 108 having upper edge surfaces 110 that upwardly bear against opposite end portions of the shaft 86 as best illustrated in FIGS. 6 and 7. Accordingly, due to the biasing force of the spring 106 (see FIG. 5) the opposite ends of the shaft 86 are biased toward the upper ends of the body wall slots 96, thereby also resiliently holding the drag wheel in a position in which it is slightly offset to the right of the vertical axis of the detection structure 20a as viewed in FIG. 5.

Figure 8:
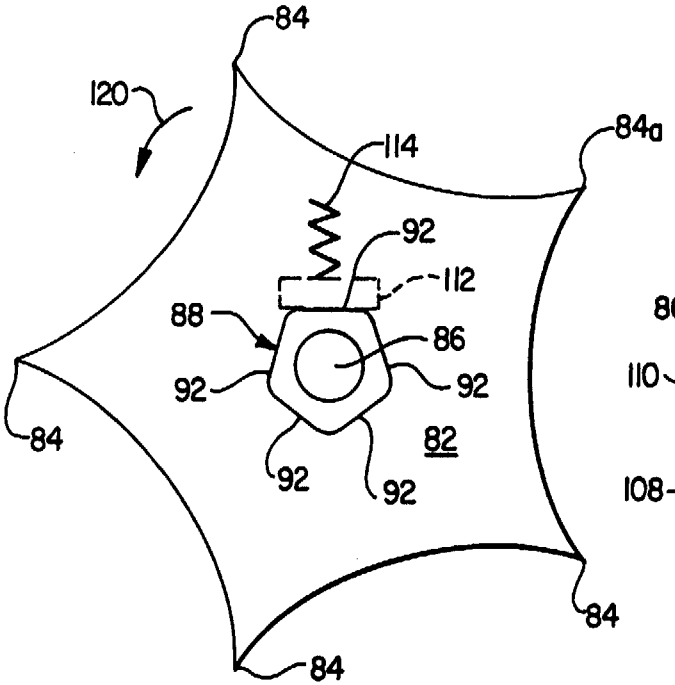
FIG. 8 is a left side elevational view of the drag member.

As schematically shown in FIG. 8, a small detent plate 112 is biased downwardly into resilient engagement with the uppermost lateral side surface 92 of the detent boss 88 by means of a spring 114. This resiliently inhibits rotation of the shaft 86. Forced rotation of the shaft 86 lifts the plate 112 and then permits it to be driven downwardly onto the next adjacent side surface portion 92 by the spring 114.

Figure 9:
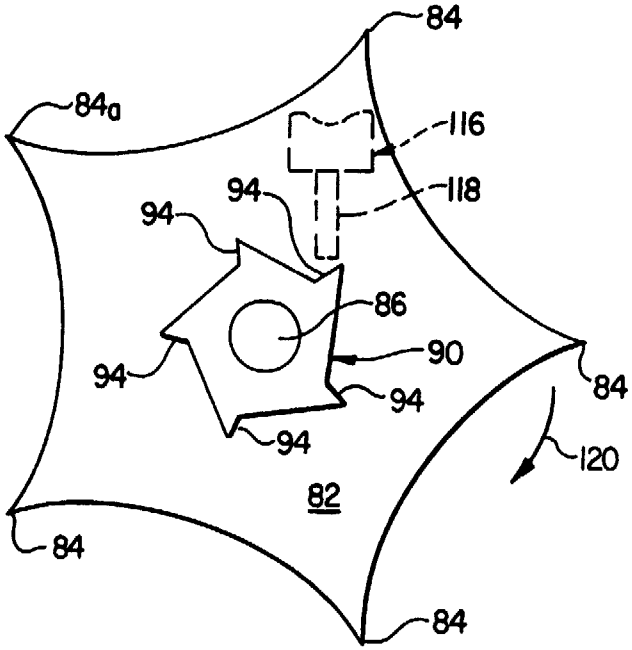
FIG. 9 is a right side elevational view of the drag member.

As schematically shown in FIG. 9, an electrically drivable solenoid structure 116 is disposed above the ratchet boss 90, in a rightwardly offset relationship therewith, and has a downwardly projecting, vertically reciprocable plunger portion 118 positioned to downwardly and drivingly engage one of the boss driving surfaces 94 to rotate the drag wheel 82 in the direction indicated by the arrows 120 in FIGS. 8 and 9. The solenoid 116 is coupled to the battery 64 (see FIG. 4), and momentarily actuated in response to the generation of the electrical output signal 78, in the same manner as the previously described solenoid 66 incorporated in the collar detection structure 20.

Referring again to FIG. 5, prior to the momentary actuation of the solenoid 116 in response to the generation of the electrical output signal 78 the drag wheel 82 is resiliently held in its initial rotational position 82a by the engagement of the detent plate 112 (see FIG. 8) with the uppermost side surface portion 92 of the detent boss 88. None of the drag wheel points 84 are in engagement with the interior side surface of the casing 12, and the reference wheel point 84a projects at an upwardly and rightwardly inclined angle as viewed in FIG. 5.

As the collar detection structure 20a is being pulled upwardly through the casing 12, as indicated by the arrow 122 in FIG. 5, and the solenoid 116 is momentarily energized in response to the sensing of a collar joint 18, the solenoid plunger 118 is driven downwardly into engagement with a facing one of the ratchet boss drive surfaces 94 (see FIG. 9), in a manner rotating the drag wheel from its initial position 82a to its second rotational position 82b, and is then retracted. When the drag wheel 82 reaches its position 82b the reference point 84a engages the interior side surface of the casing 12.

Further upward movement of the collar detection structure 20a through the casing 12 causes the point-engaged casing interior surface portion to forcibly rotate the drag wheel 82 in direction 120 while at the same time forcing the ends of the drag wheel shaft 86 downwardly and to the left in their associated body slots 96. This downward movement of the shaft ends in the slots 96 caused the pressure plate 102 to be downwardly driven against the resilient force of the spring 106. Accordingly, both the rotation of the drag wheel 82 past its position 82b and its leftward shifting are resiliently resisted by the spring 116. This resilient resistance creates a momentarily increased tension force in the slick line 22, thereby correspondingly creating another tension spike 38a on the recorder strip 40 (see FIG. 3).

The drag wheel is then rotated to its position 82c at which time the reference wheel point 84a is driven over center to permit the spring 106 to return the drag wheel to its original position 82a, the drag wheel being releasably held in such original position (until the solenoid 116 is again actuated) by the resilient engagement of the detent plate 112 (see FIG. 8) with the next adjacent boss side surface 92). It should be noted that, due to the previously mentioned rightward offset of the section 52a in the casing 12 (as viewed in FIG. 5), none of the drag wheel points 84 come into engagement with the left side of the interior casing side surface.

As in the case of the previously described detection structure 20, the detection structure 20a may also be used in any one of three alternative modes if desired. For example, as the detection structure 20a is raised through the collars to be detected, its drag structure may be held in forcible sliding contact with the inner side surface of the casing 12 and momentarily withdrawn from such contact in response to the sensing of each collar to thereby create momentary slick line tension decreases that are indicative of the detection of each collar. Additionally, the detection structure 20a may be used to detect the collars as it is lowered through the collars—with the drag portion of the detection structure 20a either being (1) momentarily brought into engagement with the casing, or (2) momentarily disengaged from the casing in response to the electromagnetic sensing of each collar as desired, as previously discussed in conjunction with the detection structure 20.

Figure 13:
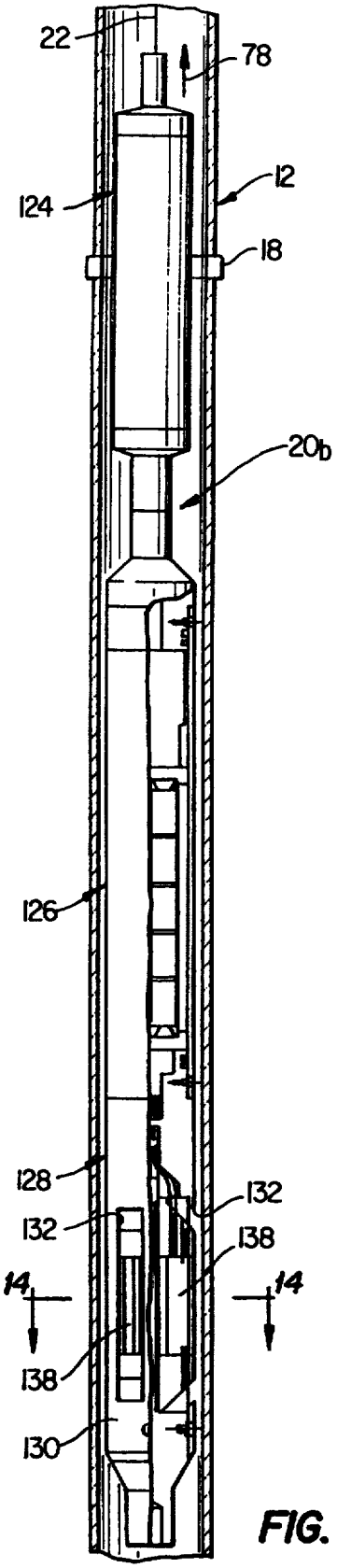
FIG. 13 is partially quarter-sectioned schematic side elevational view of a second alternate embodiment of the joint logging structure.
Figure 14A:
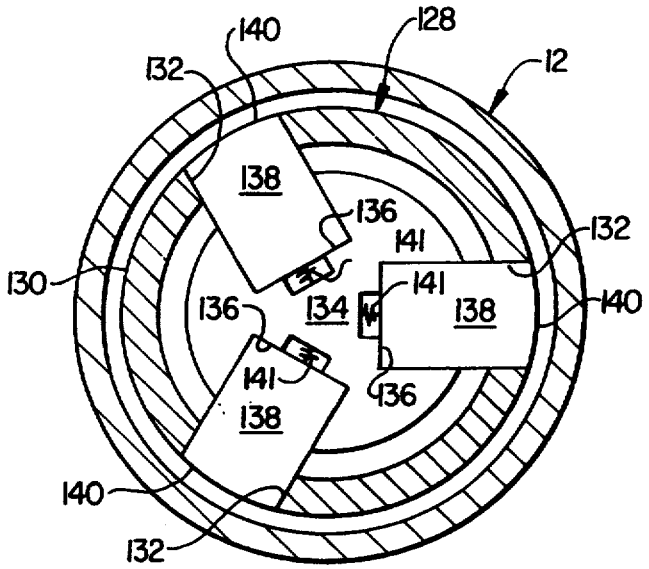
FIGS. 14A and 14B are enlarged scale cross-sectional views taken through the second alternate joint logging structure embodiment along line 14—14 of FIG. 13.
Figure 14B:
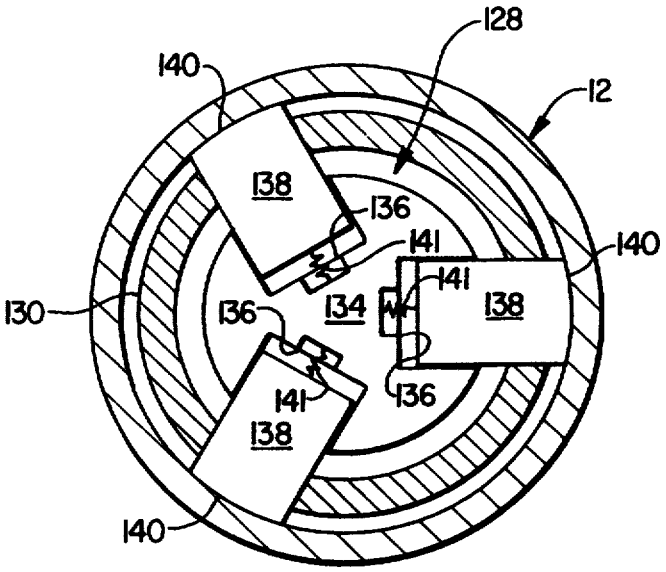

A second alternate embodiment 20b of the detection structure 20 is schematically depicted in FIGS. 13–14B and comprises, from top to bottom along its length, an electromagnetic collar sensing section 124, a battery pack section 126, and a drag structure 128. Drag structure 128 includes a generally tubular outer housing 130 having a circumferentially spaced plurality of vertically elongated slots 132 formed therein. Coaxially disposed within the housing 130 is a cylindrical guide member 134 having a circumferentially spaced plurality of recesses 136 extending radially inwardly from its outer side surface. The recesses 136 slidingly carry a plurality of electromagnetic drag pad members 138 for radial movement relative to the housing 130, inwardly and outwardly through its slots 132, between retracted positions shown in FIG. 14A and extended positions, shown in FIG. 14B, in which arcuate outer side surfaces 140 of the drag pad members 138 engage the inner side surface of the casing 12. Schematically depicted compression spring means 141 bias the drag pad members 138 radially outwardly toward their FIG. 14B extended positions, in which the radially outer sides of the drag pad members slidingly engage the interior surface of the casing 12, and permit the drag pad members to be resiliently deflected inwardly toward their FIG. 14A retracted positions in the event that the outwardly deflected drag pad members 138 strike inwardly projecting portions of the inner casing surface as the detection structure 20b is being vertically moved through the casing.

The electromagnetic drag pad members 138 are electrically coupled to the battery pack section 126 and, in the version of the detection structure 20b illustrated in FIG. 13, are energized by the battery pack section in response to the momentary generation of the electrical signal 78 when the collar sensing section 124 passes through and electromagnetically detects one of the collars 18. In response to their momentary energization by the battery pack section 126, the drag pad members 138 are magnetized and attracted to the metal casing 12. This, in turn, increases the sliding frictional resistance to vertical movement of the detection structure 20b relative to the casing 12.

If the detection structure 20b is being used to detect the depths of the collars 18 as it upwardly traverses them, the momentary magnetic attraction of the drag pad members 138 to the casing 12 creates a momentary increase in the tension in the slick line 12 indicative of the presence of the collar sensing section 124 within one of the collars 18. Conversely, if the detection structure 20b is being used to detect the depths of the collars 18 as it downwardly traverses them, the momentary magnetic attraction of the drag pad members 138 to the casing 12 creates a momentary decrease in the tension in the slick line 12 indicative of the presence of the collar sensing section 124 within one of the collars 18.

The detection structure 20b may also be utilized, when vertically moving either upwardly or downwardly through the collars 18 to be detected, with the electromagnetic drag pad members 138 being maintained by the battery pack section 126 in their energized states, until momentarily de-energized, in response to the generation of the electrical collar sensing signal 78. In this mode of operation the drag pad members 138 magnetically but yieldingly resist vertical movement of the detection structure 20b through the casing 12 except when the electromagnetic drag pad members 138 are momentarily de-energized during the existence of the electrical signal 78.

When the collars 18 are being sensed during upward movement of the detection structure 20b therethrough this momentary de-energization of the pad members 138 creates momentary decreases in the slick line tension force that are each indicative of the sensing of one of the collars 18. Conversely, when the collars 18 are being sensed during downward movement of the detection structure 20b therethrough this momentary de-energization of the pad members 138 creates momentary increases in the slick line tension force that are each indicative of the sensing of one of the collars 18.

Figure 15:
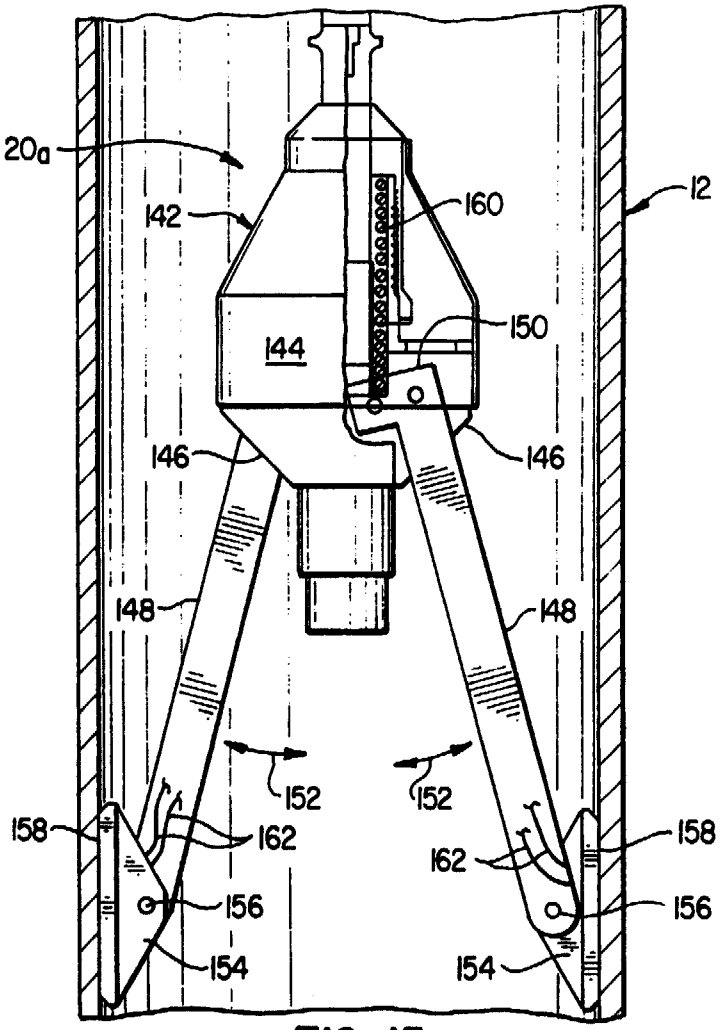
FIG. 15 is a partially quarter-sectioned schematic side elevational view of a lower end portion of a third alternate joint logging structure embodiment.

The drag section 142 of a third alternate embodiment 20c of the collar detection structure is illustrated in FIG. 15. The drag section 142 is located at the bottom end of the detection structure 20c which, except for its drag section, is similar to the detection structures previously discussed herein. Drag section 142 includes a circularly cross-sectioned housing 144 with a diametrically opposite pair of openings 146 formed in its lower end. A pair of elongated drag arm members 148 have angled inner end portions 150 that extend upwardly through the openings 146 and are pivotally secured within the housing 144 in a manner permitting the arm members 148 to pivot toward and away from one another as indicated by the arrows 152 in FIG. 15.

A pair of electromagnetic drag pads 154 are pivotally secured, as at 156, to the lower or outer ends of the drag arm members 148 and have outer side surfaces 158 that may be brought into sliding contact with the inner side surface of the casing 12 when the arms 148 are pivoted in a radially outward direction. The drag arm members 148 are pivotally biased in this radially outward direction, to resiliently hold the pad surfaces 158 in sliding contact with the inner side surface of the casing 12, by a coiled compression spring 160 captively retained within the housing 144 and bearing at its lower end against the upper or inner ends 150 of the drag arm members 148 as indicated.

The electromagnetic drag pads 154 are electrically coupled to the battery pack section of the detection structure (not shown in FIG. 15) by schematically depicted leads 162. The battery pack section, in response to the collar sensing section electrical output signal 78, is thus operative to energize or de-energize the electromagnetic drag pads 154 as desired.

In one available mode of operation thereof, as the detection structure 20c is moved upwardly through the casing collars to be detected, the drag pads 154 are electrically de-energized and slide along the interior of the casing 12 but are not magnetically attracted to it. When the collar sensing section of the detection structure 20c senses a collar, the resulting momentary electrical output signal 78, via the battery pack section and the leads 162, momentarily energizes the drag pads 154. This momentarily creates a magnetic attraction between the drag pads 154 and the casing 12, thereby momentarily increasing the slick line tension to create measurable tension spikes, such as the spikes 38a shown in FIG. 3, indicative of the depths of the collars being sensed. The resiliently biased, pivotally mounted drag arm members 148 advantageously permit the same drag structure 142 to be used in casings, or other jointed tubular structures, having differing inside diameters.

Alternatively, as the detection structure 20c is being moved upwardly through the collars to be sensed, the electromagnetic drag pads 154 may be maintained in an energized state and momentarily de-energized in response to the generation of the collar sensing electrical output signal 78. Under this mode of operation the detection of each collar will be indicated by a momentary decrease in the slick line tension.

The detection structure 20c may also be used to detect collars as it is being moved downwardly through the collars to be detected —with the electromagnetic drag pads 154 either normally energized or normally de-energized. When the drag pads 154 are normally de-energized, and energized during downward movement of the detection structure 20c through the collars to be sensed, the detection of each collar will be mechanically indicated by a momentary decrease in the slick line tension. Conversely, when the drag pads 154 are normally energized, and de-energized during downward movement of the detection structure 20c through the collars to be sensed, the detection of each collar will be mechanically indicated by a momentary increase in the slick line tension.

Figure 16:
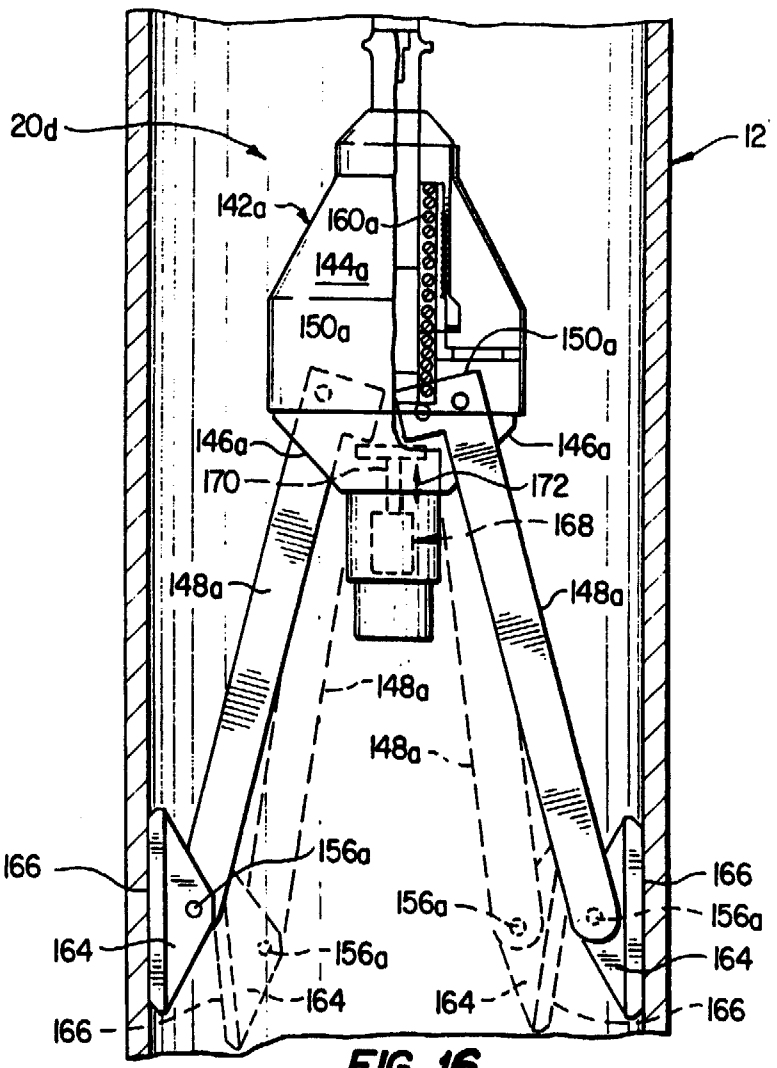
FIG. 16 is a partially quarter-sectioned schematic side elevational view of a lower end portion of a fourth alternate joint logging structure embodiment.

The drag section 142a of a fourth alternate embodiment 20d of the detection structure is illustrated in FIG. 16 and, with the exceptions noted below, is similar to the previously described drag structure 142 shown in FIG. 15. For ease in comparison, components in the drag section 142a similar to those in drag structure 142 have been given identical reference numerals with the subscript "a".

In the drag section 142a the electromagnetic drag pads 154 are replaced with frictional drag pads 164 having outer side surfaces 166. Unlike the previously described drag pads 154, the drag pads 164 are not electrically coupled to the battery pack portion of the detection structure 20d. The compression spring 160a pivotally biases the drag arm members 148a radially outwardly toward their solid line positions in which the outer side surfaces 166 of the drag pads 164 frictionally and slidably engage the inner side surface of the casing 12.

Disposed within a lower end portion of the housing 144a is a solenoid 168 that is electrically coupled to the battery pack portion of the detection structure 20d. Solenoid 168, at its upper end, has a plunger portion 170 that is vertically movable as indicated by the double-ended arrow 172. When the plunger portion 170 is driven upwardly, an upper end portion thereof forcibly engages the undersides of the upper drag arm ends 150 and forcibly pivots the drag arms 148a, and the drag pads 164, to their dotted line positions in which the outer sides 166 of the drag pads 164 are moved inwardly out of frictional contact with the inner side surface of the casing 12. When the plunger portion 170 is retracted the spring 160a operates to forcibly pivot the drag arms 148a and the drag pads 164 outwardly to their solid line positions.

In one mode of operation thereof, the detection structure 20d is used to detect the collars 18 as the detection structure 20d is moved upwardly through the collars with the solenoid plunger portion upwardly extended to hold the drag arms 148a and the drag pads 164 in their dotted line retracted positions. When the collar sensing section of the detection structure 20d senses a collar and responsively outputs the previously described momentary electrical signal 78, the signal 78 is used (via the battery pack section) to retract momentarily retract the solenoid plunger portion 170 to momentarily permit the spring 160a to pivot the drag pads 164 outwardly to their solid line positions. In turn, the resulting frictional engagement of the drag pad side surfaces 166 with the inner side surface of the casing 12 creates an associated momentary slick line tension increase indicative of the sensing of the collar.

The solenoid plunger portion 170 may of course be normally maintained in its retracted position as the detection structure 20d upwardly traverses the collars to be sensed. In this case the electrical output signal 78 may be used to momentarily extend the plunger portion 170, thereby creating a momentary slick line tension decrease indicative of the sensing of one of the casing collars.

Alternatively, the detection structure 20d may be used to sense the collars while the detection structure 20d is downwardly traversing the collars - with the solenoid plunger portion 170 in either a normally retracted position or a normally extended position. In this downward sensing travel mode of the detection structure 20d, with the solenoid plunger portion 170 in a normally extended orientation, generation of the electrical output signal 78 will automatically create a momentary slick line tension decrease indicative of the sensing of one of the collars, and with the solenoid plunger portion 170 in a normally retracted orientation, generation of the electrical output signal 78 will automatically create a momentary slick line tension increase indicative of the sensing of one of the collars.

As will be appreciated, in the representatively illustrated detection structures 20–20d a variety of other types of drag structures could be alternately utilized if desired. Additionally, while the elongated positioning member used to vertically move the detection structures 20–20d through the casing 12 is representatively a slick line, a variety of other elongated positioning members (such as coil tubing or braided metal line) could be alternately utilized if desired. Additionally, while the detection structures 20–20d have been illustrated and described herein as being used to sense casing collar joints or other increased mass sections of the casing, it will be appreciated by those of skill in this particular art that they could also be used in various applications to detect decreased mass sections of the casing, such as perforated portions thereof.

Moreover, as will be readily appreciated by those of skill in this particular art, the representatively illustrated detection structures 20–20d could also be advantageously utilized to detect changed mass sections in other types of downhole jointed tubular structures, such as production tubing, in subterranean wells.

While various types of mechanical and electromagnetic drag structures have been illustrated and described herein to momentarily create in the slick line or other elongated positioning member a detectable tension change, it will also be readily appreciated by those of skill in this art that various other means could be used to create the detectable tension changes. For example, the drag systems could be replaced with pyrotechnic or compressed gas devices that are operative in response to the electrical output signals to momentarily accelerate the detection structure (either upwardly or downwardly) during vertical movement of the detection structure, to thereby momentarily create either a tension increase or decrease in the slick line or other elongated positioning member.

The foregoing detailed description is to be clearly understood as being given by way of illustration and example only, the spirit and scope of the present invention being limited solely by the appended claims.

What is claimed is:

1. A method of accurately determining the depth of a changed mass section of a jointed tubular structure in a subterranean well, such as a well bore casing or production tubing, without the necessity of transmitting electrical signals upwardly to the surface through an electrically conductive wire line member, said method comprising the steps of:

vertically moving a detection structure, on an elongated positioning member, through the tubular structure and through the changed mass section therein whose depth is to be determined;

causing the moving detection structure to automatically generate an electrical signal as it moves through the changed mass section;

using the generated electrical signal to cause a portion of the moving detection structure to momentarily and detectably change the tension in said elongated positioning member;

detecting the momentary tension change in said elongated positioning member; and utilizing the detected momentary positioning member tension change to determine the depth of the changed mass section of the jointed tubular structure.

2. The method of claim 1 wherein:

said vertically moving step is performed by moving said detection structure upwardly through the changed mass section, and said using step is performed by causing said portion of said detection structure to momentarily increase the tension in said elongated positioning member.

3. The method of claim 1 wherein:

said vertically moving step is performed by moving said detection structure upwardly through the changed mass section, and said using step is performed by causing said portion of said detection structure to momentarily decrease the tension in said elongated positioning member.

4. The method of claim 1 wherein:

said vertically moving step is performed by moving said detection structure downwardly through the changed mass section, and said using step is performed by causing said portion of said detection structure to momentarily increase the tension in said elongated positioning member.

5. The method of claim 1 wherein:

said vertically moving step is performed by moving said detection structure downwardly through the changed mass section, and said using step is performed by causing said portion of said detection structure to momentarily decrease the tension in said elongated positioning member.

6. The method of claim 1 wherein:

said vertically moving step is performed using a slick line as the elongated positioning member.

7. The method of claim 1 wherein:

said portion of said detection structure is slidably and frictionally engageable within the inner side surface of the jointed tubular structure, and said using step is performed by momentarily altering the sliding friction force between said detection structure portion and the inner side surface of the jointed tubular structure.

8. The method of claim 1 wherein:

said portion of said detection structure and the jointed tubular structure are magnetically attractable to one another, and said using step performed by momentarily altering the magnetic attraction force between said detection structure portion and the jointed tubular structure.

9. The method of claim 1 wherein the changed mass section is a casing collar joint, and said method is used to detect the depth of the casing collar joint.

10. The method of claim 1 wherein:

said causing step includes the step of electromagnetically sensing the changed mass section of the jointed tubular structure.

11. A method of accurately determining the depths of a longitudinally spaced plurality of changed mass sections in a downhole tubular structure, such as a well bore casing or production tubing, in a subterranean well, said method comprising the steps of:

providing a mass change detection structure;

securing said mass change detection structure to an end of an elongated positioning member;

lowering said mass change detection structure into the tubular structure on said elongated positioning member;

moving the lowered mass change detection structure vertically through the spaced plurality of changed mass sections;

causing the vertically moving mass change detection structure to generate an electrical signal as it interiorly traverses each of the spaced plurality of changed mass sections;

momentarily causing a portion of said mass change detection structure, in response to the generation of each electrical, to cooperate with the tubular structure in a manner momentarily and detectably changing the tension in said elongated positioning member;

detecting the momentary tension changes in said elongated positioning member;

utilizing the detected tension changes to determine the depth of each of the spaced plurality of changed mass sections;

using the determined depths of the changed mass sections to determine the spacing between each vertically adjacent pair of the plurality of changed mass sections; and matching the set of determined section-to-section spacings to a corresponding set of section-to-section spacings on a previously recorded changed mass section log and tally to determine precisely which changed mass sections have been logged using said mass change detection structure.

12. The method of claim 11 wherein:

said securing step is performed by securing said mass change detection structure to an end of a slick line.

13. A method of positioning a tool within a downhole tubular structure, such as a well bore casing or production tubing, in a subterranean well, at a precise, predetermined distance from a previously installed structure therein, the tubular structure having a longitudinally spaced series of changed mass sections and an associated changed mass section and tally log indicating the depth of the previously installed structure in the tubular structure, said method comprising the steps of:

lowering a mass change detection structure into the tubular structure on an elongated positioning member;

using said elongated positioning member to vertically move the lowered mass change detection structure through the changed mass sections in a predetermined longitudinal portion of the tubular structure;

causing the moving mass change detection structure to automatically generate an electrical signal each time it passes through one of the changed mass sections in said predetermined longitudinal portion of the tubular structure;

causing the moving mass change detection structure to cooperate with the tubular structure, in response to each of the generated electrical signals, in a manner detectably changing the tension in said elongated positioning member;

detecting the tension changes in said elongated positioning member;

utilizing the detected tension changes to measure the distance between each longitudinally successive pair of the changed mass sections in said predetermined longitudinal portion of the tubular structure by recording the downhole length of said elongated positioning member corresponding to each detected tension change therein;

correlating the measured section-to-section distances to dimensional data in the changed mass section and tally log in a manner establishing a positioning member run-in length precisely corresponding to the desired tool depth in the tubular structure; and supporting the tool within the tubular structure on an elongated positioning member having a downhole length identical to the positioning member run-in length established in said correlating step.

14. The method of claim 13 wherein:

said supporting step is performed using the same elongated positioning member used in said lowering step.

15. The method of claim 14 wherein:

said tool is lowered into the tubular structure with said mass change detection structure on said elongated positioning member.

16. A detection structure, movable through a downhole tubular structure, such as a well bore casing or production tubing in a subterranean well, on an end of an elongated positioning member extending into the tubular structure, for detecting the location of a changed mass portion of the tubular structure such as a joint therein, said detection structure comprising:

first means for sensing the changed mass portion as said detection structure moves therethrough, and responsively generating an electrical output signal; and second means, responsive to the generation of said electrical output signal, for utilizing a portion of the detection structure to momentarily create in the elongated positioning member a detectable tension change indicative of the downhole position of the sensed changed mass portion of the tubular structure.

17. The detection structure of claim 16 wherein:

said first means are operative to electromagnetically sense the changed tubular structure mass portion.

18. The detection structure of claim 17 wherein:

said first means include an electromagnetic coil structure.

19. The detection structure of claim 16 wherein said second means include:

a drag structure having a motion inhibiting portion movable between a retracted position in which said motion inhibiting portion is spaced apart from the inner side surface of the tubular structure, and an extended position in which said motion inhibiting portion is in sliding frictional contact with the inner side surface of the tubular structure, and means, responsive to the generation of said electrical output signal, for momentarily moving said motion inhibiting portion from one of said retracted and extended positions to the other of said retracted and extended positions.

20. The detection structure of claim 19 wherein:

said drag structure has a hollow housing extending along an axis and having a lower portion with a circumferentially spaced plurality of slots therein, said motion inhibiting portion includes a plurality of elongated drag arm members having upper end portions extending inwardly through said slots and being pivotally secured within said hollow housing, and lower end portions having frictional drag pads secured thereto, said drag arm members being inwardly pivotable to said retracted position in which said drag pads are spaced inwardly apart from the inner side surface of the tubular structure, and being outwardly pivotable to said extended position in which said drag pads are in sliding frictional engagement with the inner side surface of the tubular structure, and said means for momentarily moving said motion inhibiting portion include spring means for resiliently biasing said drag arm members toward said extended position, and solenoid means operable in response to said electrical output signal to releasably hold said drag arm members in said retracted position.

21. The detection structure of claim 16 wherein said second means include a drag structure having:

a hollow housing extending along an axis and having a circumferentially spaced plurality of slots therein a plurality of elongated drag arm members with upper end portions extending inwardly through said slots and being pivotally secured within said hollow housing, and lower end portions having electromagnetic drag pad members thereon, said drag arm members being pivotable relative to said hollow housing between said retracted position in which said electromagnetic drag pad members are spaced inwardly apart from the inner side surface of the tubular structure, and said extended position in which said drag pad members are in sliding frictional contact with the inner side surface of the tubular structure, spring means for resiliently and pivotally biasing said drag arm members toward said extended position thereof, and electrical means, responsive to said electrical output signal, for selectively magnetizing and de-magnetizing said electromagnetic drag pad members.

22. The detection structure of claim 16 wherein said second means comprise a drag structure having motion inhibiting portion including:

a hollow housing extending along an axis and having a circumferentially spaced plurality of radial slots therein, a plurality of electromagnetic drag pad members carried in said housing for radial movement through said slots between retracted and extended positions, spring means for resiliently biasing said electromagnetic drag pad members to said extended positions thereof, and electrical means for selectively magnetizing and demagnetizing said plurality of electromagnetic drag pad members.

* * * * *